United States Patent [19]

Jalil

[11] Patent Number: 4,581,078

[45] Date of Patent: Apr. 8, 1986

[54] METHOD FOR ROLLING AND HEAT TREATING SMALL DIAMETER STAINLESS STEEL ROD

[75] Inventor: Asjed A. Jalil, Holden, Mass.

[73] Assignee: Morgan Construction Company, Worcester, Mass.

[21] Appl. No.: 635,713

[22] Filed: Jul. 30, 1984

[51] Int. Cl.[4] ..... C21D 7/14

[52] U.S. Cl. ..... 148/12 B; 148/12 E

[58] Field of Search ..... 148/12 B, 12 E, 156; 266/106; 72/201

[56] References Cited

U.S. PATENT DOCUMENTS

| | | | |
|---|---|---|---|
| 4,168,993 | 9/1979 | Wilson et al. | 148/12 B |
| 4,174,981 | 11/1979 | Cassell | 148/12 B |
| 4,295,900 | 10/1981 | Malmgren et al. | 148/12 B |
| 4,360,390 | 11/1982 | Tominaga et al. | 148/12 B |
| 4,369,645 | 1/1983 | Brauer | 148/12 B |

*Primary Examiner*—Wayland Stallard

*Attorney, Agent, or Firm*—Thompson, Birch, Gauthier & Samuels

[57] ABSTRACT

A method for rolling and heat treating small diameter stainless steel rod, comprising the following sequence of steps: cooling the rod prior to and during finish rolling to increase its stiffness; passing the rod through a sizing mill to achieve close tolerances; subjecting the rod to additional water cooling to thereby improve its resistance to surface scratching; forming the rod into rings which are received in an offset pattern on an open moving conveyor; subjecting the offset rings moving along the conveyor to a solid solutioning treatment by reheating and water quenching the same; and then air cooling and drying the rings before collecting them into coils.

7 Claims, 2 Drawing Figures

METHOD FOR ROLLING AND HEAT TREATING SMALL DIAMETER STAINLESS STEEL ROD

BACKGROUND OF THE INVENTION

This invention relates to the production of small diameter austenitic stainless steel products of the type commonly used in the cold heading trade. As herein employed, the term "small diameter" defines products ranging in diameter from about 4.0 to 5.5 mm.

A combination of problems, including lack of stiffness, unacceptable tolerances, surface scratching in the laying heads, etc. has heretofore made it impossible to consistently roll such products as rods on a rod mill. Thus, such products have been conventionally produced as heat treated drawn wires, for which a price premium is paid.

SUMMARY OF THE PRESENT INVENTION

A basic objective of the present invention is to overcome to above-mentioned problems, thereby making it possible to consistently produce small diameter austenitic stainless steel products as rods on a rod mill, at a considerable cost saving as compared to conventional wire drawing techniques.

In a preferred embodiment of the invention to be described hereinafter in more detail, this is accomplished by continuously hot rolling a process section, for example a reheated billet, into a small diameter rod by passing the same through a succession of roughing and intermediate stands and then through a finishing block. The process section is water cooled prior to its entry into as well as during its passage through the finishing block. The resulting reduction in rod surface temperature to about 900° C. is sufficient to advantageously increase the stiffness of the rod emerging from the finishing block. As herein employed, the term "about", when used in connection with temperatures, defines a range of ±50° C.

After being allowed to substantially equalize to a bulk temperature of about 950° C., the thus stiffened rod is passed through a sizing mill which imparts to the rod a tolerance of about ±0.04 mm. As herein employed, the term "bulk temperature" means the equalized temperature between the core end surface of the rod, and the term "sizing mill" means one or more roll passes wherein the total reduction imparted to the rod is 10% or less. The rod exiting from the sizing mill is then subjected to additional water cooling prior to being directed through a laying head where it is formed into a continuous series of rings. Preferably, this additional water cooling will reduce the surface temperature of the rod to about 650° C. This enables the rod to resist surface scratching during passage through the laying head.

The rings formed by the laying head are received on a conveyor along which they are transported in a mutually offset relationship. While moving along the conveyor, the offset rings are sequentially reheated to an elevated bulk temperature of about 1100° C., then water quenched at a rate of between about 200° to 800° C./sec. to a surface temperature of about 300° C., with an accompanying decrease in core temperature to about 750° C. Air cooling of the rings then continues at a more gradual rate while drying the same. The rings are then collected from the delivery end of the conveyor into cylindrical coils.

This combination of steps will enable small diameter, close tolerance, scratch-free, heat treated stainless steel rod to be rolled on a rolling mill at significantly reduced costs as compared to conventional wire drawing methods. For example, it is conservatively estimated that, with the cost of all other things being equal, e.g., raw materials, fuel and labor, the above-described process will make it possible to achieve approximately a 50% cost savings per ton as compared to the production of conventional heat treated drawn wires.

DETAILED DESCRIPTION OF ILLUSTRATIVE EMBODIMENT

It will be understood that the components in the illustrated rod mill are well known to those skilled in the art. Consequently, they have been shown in diagrammatric form, since the invention resides not in the specific form of such components, but rather in the method or process of operating them in combination.

Figure 1A:
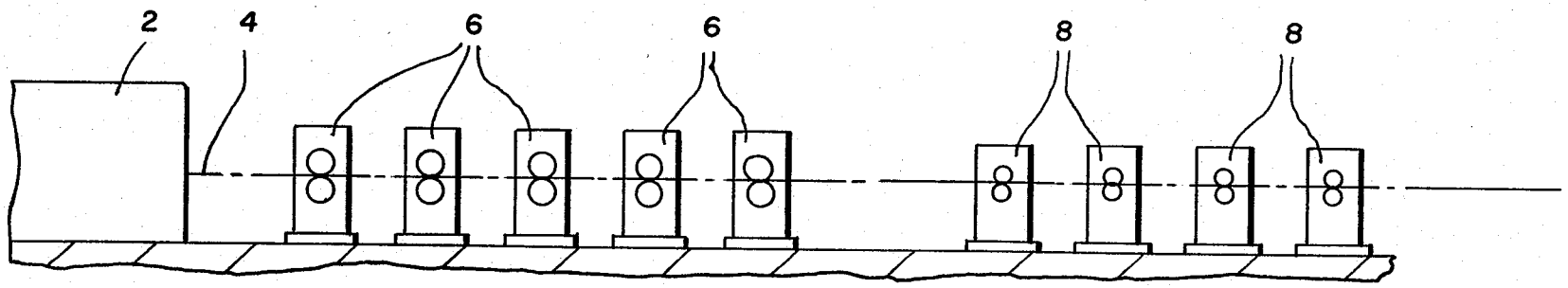
FIG. 1A is an illustration of one portion of a rod mill in accordance with the present invention, including the billet reheat furnace and the roughing and intermediate mill stands.
Figure 1B:
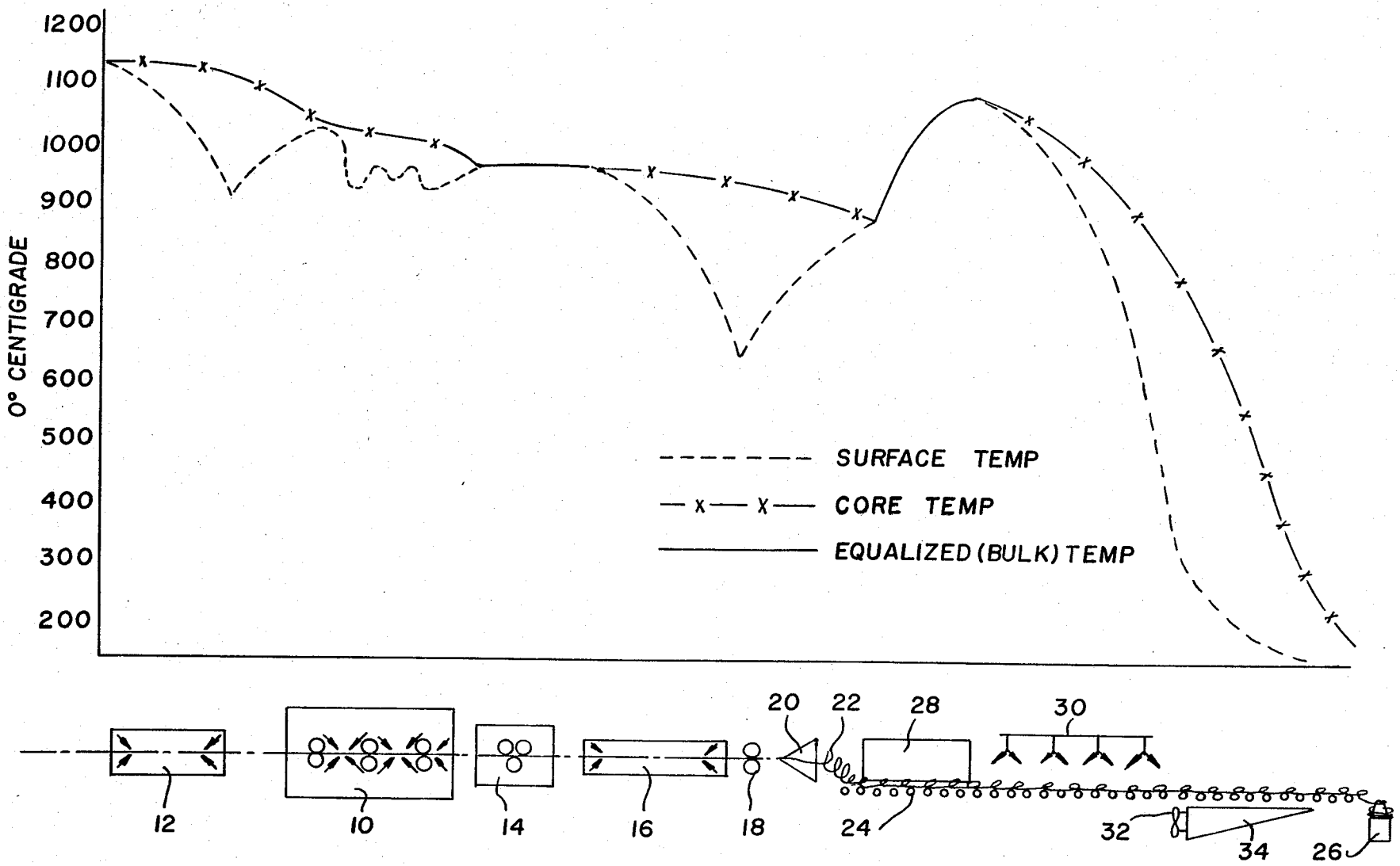
FIG. 1B is a graph illustrating surface, core and bulk temperatures of a rod being processed through the remaining portion of the same rod mill, with the mill components being shown along the horizontal axis of the graph, and with the vertical axis of the graph being incrementally subdivided into °C.

Referring initially to FIG. 1A, one portion of a rod mill is shown comprising a furnace 2 in which process sections such as discrete billets are reheated to a rolling temperature of above about 1040° to 1260° C. The billets are extracted from the furnace by conventional means (not shown) and are continuously rolled along the mill pass line 4 through a series of roughing stands 6, and then through a series of intermediate stands 8. Thereafter, and with reference to FIG. 1B, the semifinished product continues through a finishing block 10.

Although the successive work roll pairs of the finishing block have been illustrated horizontally, those skilled in the art will appreciate that in actual practice, the roll axes of successive roll pairs are offset by 90° so as to eliminate any twisting of the product as it progresses through the finishing block. A typical finishing block of this type is shown, for example, in U.S. Pat. No. Re. 28,107.

In accordance with the present invention, the finishing block 10 has been modified to incorporate water cooling nozzles between the successive roll pairs. As schematically depicted by the arrows in the drawing, these nozzles apply water to the surface of the product as it passes through the finishing block.

The finishing block 10 is preceded by a water box 12 which also can be of conventional design, having a succession of water nozzles through which the product is directed after leaving the last roll stand 8 of the preceding intermediate train. Again, as schematically depicted by the arrows in the drawing, the water nozzles of cooling box 12 apply cooling water to the surface of the product passing therethrough.

The finishing block 10 is followed by a sizing mill 14 which in turn is followed by another water box 16. The water box 16 is followed by a set of driven pinch rolls 18 which propel the product into and through a laying head 20. The laying head forms the product into a continuous series of rings 22 which are received on an open conveyor 24. The conveyor, which may be of any conventional chain or roller type, transports the rings in a mutually offset relationship along a path leading to a reforming station 26. As the offset rings move along the conveyor path, they pass through a furnace 28 which may be of conventional design and heated by gas burners, radiant heaters or the like. As the offset rings exit from the furnace, they are quenched by water spray nozzles 30, and then air cooled by means of a fan 32 acting through a plenum 34 underlying the conveyor. The rings are then collected from the delivery end of the conveyor into coils at the reforming station 26.

The operation of the foregoing installation will now be described with reference to a typical example wherein 5.5 mm. diameter stainless steel rod is finish rolled at a mill delivery speed of 80 m./sec. As the product enters the water box 12, it has a diameter of approximately 18 mm, a surface temperature of about 1140° C., and it is travelling at a speed of about 7.5 m./sec. The water nozzles of the water box 12 operate to lower the surface temperature of the product to about 925° C., with an accompanying lowering of the core temperature down to about 1120° C. Thereafter, the surface and core temperatures are allowed to substantially equalize to about 1037° C. before the product enters the finishing block 10.

As the product progresses through the roll passes of the finishing block, it experiences successive elongations accompanied by reductions in cross-sectional area. In the diagrammatic representation of FIG. 1B, the finishing block is illustrated as having three successive roll passes. Those skilled in the art will appreciate, however, that in actual practice the finishing block will normally include 8–10 roll passes. During this finish rolling, the water cooling nozzles between the successive roll pairs of the finishing block operate to intermittently lower the surface temperature of the product by increments averaging about 50° C. However, because of the energy being imparted to the product during finish rolling, the surface temperature rises between each water application, and the core temperature only gradually decreases with the net result being that as the rod emerges from the finishing block, its surface temperature is about 930° C., and its core temperature is about 1000° C. The surface and core temperatures then equalize to a bulk temperature of about 960° C. as the product enters and passes through the sizing mill 14. Since little if any reduction is being taken in the sizing mill, the core and surface temperatures remain relatively constant until the product enters the next water box 16. At a bulk temperature of about 960° C., the product has sufficient inherent stiffness to enter and pass through both the sizing mill 14 and the water box 16 without cobbling or breaking out.

The cooling in water box 16 reduces the surface temperature of the product to about 660° C., with an accompany-decrease in the core temperature to about 940° C. Thereafter, the surface and core temperatures equalize to a bulk temperature about 870° C. as the product continues through the driven pinch rolls 18 and the laying head 20. At this temperature, the surface of the product is able to resist scratching or marking that might otherwise result from frictional contact with the internal guide surfaces of the laying head.

As previously indicated, the product rings 22 formed by the laying head are received in an offset pattern on the conveyor 24. As the offset rings move along the conveyor, they enter the furnace 28 where they experience reheating to a bulk temperature of about 1080° C. As the rings emerge from the furnace, they are subjected to the water sprays 30 which reduce their surface temperature at a rate of approximately 200° C./sec to about 320° C., with an accompanying decrease in core temperature to just above 750° C. As the rings emerge from beneath the water nozzles 30, they pass over the plenum 34 which directs an upward flow of air from fan 32 through the rings. This further reduces the surface temperature of the rings to under 200° C. while also drying the rings. This sequential reheating and rapid surface quenching is effective in achieving the solid solution treatment required for stainless steel products. The rings are then accumulated into coils at the reforming station 26. As an alternative, the rings could be water cooled such that the core temperature is brought down to about 300° C. However, this would create a substantial difference in temperature between the surface and the core. Hence, the combination of water and air cooling is preferred.

It thus will be seen that the successive steps of the above-described process cooperate with one another to achieve the desired result. More particularly, the water cooling in water box 12 and finishing block 10 increases the stiffness of the small diameter product, thereby enabling the product to pass through downstream equipment, including the sizing mill 14 and the water box 16 without cobbling or breaking out. The sizing mill imparts the required close tolerance of about ±0.04 mm. to the rod. The additional cooling in water box 16 enables the product surface to withstand surface scratching in the laying head 20. The laying head cooperates with the conveyor 24 in arranging the product in a continuous series of offset rings moving along the conveyor path. The furnace 28 and water sprays 30 operate sequentially on the moving offset rings to achieve a substantially uniform solid solution treatment, and the fan 32 and plenum 34 operate to further cool and dry the offset rings before they are finally gathered into coil form.

The resulting product is a hot rolled, heat-treated, scratch-free, close tolerance, small-diameter stainless steel rod.

I claim:

1. A method of rolling and heat treating small diameter stainless steel rod, comprising:

(a) rolling a process section into a rod by passing the same through a succession of conventional roughing and intermediate stands and then through a conventional finishing block;

(b) water cooling the process section prior to its entry into as well as during its passage through the finishing block, with the resultant reduction in temperature being sufficient to increase the stiffness of the rod emerging from the finishing block;

(c) directing the rod emerging from the finishing block through a sizing mill which imparts to the rod a tolerance of at least about ±0.04 mm.;

(d) subjecting the rod emerging from the sizing mill to additional water cooling to further reduce the temperature thereof;

(e) directing the rod through a laying head which forms the rod into a continuous series of rings, the temperature reduction resulting from the aforesaid additional cooling being such as to increase the resistance of the rod to surface scratching during its passage through the laying head;

(f) receiving the rings from said laying head on a conveyor which transports the rings in a mutually offset relationship along a selected path;

(g) reheating the offset rings during the transport thereof along said path;

(h) subjecting the reheated offset rings to additional water cooling during the continued transport thereof along said path, the said reheating and subsequent water cooling being effective to achieve a solid solution treatment of said offset rings;

(i) blowing air through the thus treated offset rings during the continued transport thereof along said path in order to further cool and dry the same; and (j) collecting said rings from said conveyor into upstanding cylindrical coils.

2. The method of claim 1 wherein said rod is in the austenitic stainless series, with a diameter ranging from about 4.0 to 5.5 m.m.

3. The method of claim 1 wherein the rod exiting from said finishing block equalizes to a bulk temperature of about 950° C. before entering said sizing mill.

4. The method of claim 1 wherein the surface temperature of the rod entering said laying head is about 650° C.

5. The method of claim 1 wherein the offset rings on said conveyor are reheated to an elevated bulk temperature of about 1100° C.

6. The method of claim 5 wherein the reheated offset rings are water cooled at a rate of about 200° to 800° C./sec. to a surface temperature of about 300° C., with an accompanying decrease in core temperature to about 750° C.

7. A method of rolling and heat treating a small diameter stainless steel rod, comprising:

(a) rolling a process section into a rod by passing the same through a succession of conventional roughing and intermediate stands and then through a conventional finishing block;

(b) subjecting the process section to a first water cooling application prior to its entry into the finishing block as well as to a second cooling application during its passage through the finishing block, with the resultant reduction in temperature being sufficient to increase the stiffness of the rod emerging from the finishing block;

(c) directing the rod emerging from the finishing block through a sizing mill to obtain tolerances of about ±0.04;

(d) subjecting the rod emerging from the sizing mill to a third water cooling application to further reduce the temperature thereof;

(e) directing the rod through a laying head which forms the rod into a continuous series of rings, the temperature reduction resulting from said third water cooling application being such as to increase the resistance of the rod to surface scratching during its passage through the laying head;

(f) receiving the rings from said laying head on a conveyor which transports the rings in a mutually offset relationship along a given path;

(g) reheating the offset rings during the transport thereof along said path;

(h) subjecting the reheated offset rings to a fourth water cooling application during the transport thereof along said path, the said reheating and fourth water cooling application being effective to achieve a solid solution treatment of said offset rings;

(i) blowing air through the thus treated offset rings during the continued transport thereof along said path in order to futher cool and dry the same; and (j) collecting said rings from said conveyor into upstanding cylindrical coils.

* * * * *